US006295692B1

(12) United States Patent
Shideler

(10) Patent No.: US 6,295,692 B1
(45) Date of Patent: Oct. 2, 2001

(54) CONVERTIBLE VACUUM CLEANER

(75) Inventor: Larry R. Shideler, Boise, ID (US)

(73) Assignee: Pro-Team, Inc., Boise, ID (US)

( * ) Notice: Subject to any disclaimer, the term of this patent is extended or adjusted under 35 U.S.C. 154(b) by 0 days.

(21) Appl. No.: 09/568,637

(22) Filed: May 10, 2000

(51) Int. Cl.[7] ..... A47L 5/24; A47L 5/28; A47L 5/36

(52) U.S. Cl. ..... 15/327.5; 15/328; 15/329; 15/330

(58) Field of Search ..... 15/328, 329, 327.5

(56) References Cited

U.S. PATENT DOCUMENTS

| | | | | |
|---|---|---|---|---|
| 2,456,639 | * | 12/1948 | Lanter | 15/329 X |
| 3,286,446 | * | 11/1966 | Happe et al. | 15/327.5 X |
| 3,310,828 | | 3/1967 | Clark et al. . | |
| 4,393,536 | | 7/1983 | Tapp . | |
| 4,458,377 | * | 7/1984 | Frohbieter | 15/328 X |
| 4,660,246 | * | 4/1987 | Duncan et al. | 15/329 |
| 4,670,937 | * | 6/1987 | Sumerau et al. | 15/329 |
| 4,766,638 | * | 8/1988 | McDowell | 15/329 |
| 4,809,395 | | 3/1989 | Fleischhauer . | |
| 4,845,793 | | 7/1989 | Meyer . | |
| 5,054,157 | | 10/1991 | Werner et al. . | |
| 5,715,556 | * | 2/1998 | Weaver et al. | 15/327.5 X |
| 5,735,018 | | 4/1998 | Gallagher et al. . | |
| 5,794,303 | | 8/1998 | Sanfilippo et al. . | |
| 5,836,046 | * | 11/1998 | Huffman et al. | 15/327.5 X |
| 5,836,047 | | 11/1998 | Lee et al. . | |
| 5,842,254 | | 12/1998 | Lee . | |
| 6,058,559 | * | 5/2000 | Yoshini et al. | 15/328 |
| 6,151,749 | * | 11/2000 | Berfield | 15/327.5 |

FOREIGN PATENT DOCUMENTS

| | | | | |
|---|---|---|---|---|
| 452211 | * | 8/1936 | (GB) | 15/329 |
| 1151990 | * | 5/1969 | (GB) | 15/329 |

* cited by examiner

*Primary Examiner*—Chris K. Moore
(74) *Attorney, Agent, or Firm*—Robert L. Shaver; Frank J. Dykas; Stephen M. Nipper

(57) ABSTRACT

The present invention is a vacuuming apparatus convertible between a backpack mode, a canister mode and an upright mode. Additionally, the present invention is convertible into a handheld mode and a blower mode. Each of these modes are accomplished through attachments which are able to be easily attached and detached together. The apparatus has a power unit having an electric motor and impeller; a base unit containing a filter; a backpack unit for use in the backpack mode; a canister unit for use in the canister mode; a blower unit for use in the blower mode; a handheld unit for use as a handheld vacuum cleaner in a hand held mode; and a work bench waste collection mode.

21 Claims, 16 Drawing Sheets

10

CONVERTIBLE VACUUM CLEANER

BACKGROUND OF THE INVENTION

1. Field of the Invention

The present invention generally relates to vacuum cleaners, and more particularly to vacuum cleaners able to be converted into various usability modes. Examples of these different types or modes include upright models, canister models, backpack models, hand-held models, and blowers.

2. Background Information

Canister vacuum cleaners often comprise a vacuum means enclosed in a canister which rests upon the floor surface either in a horizontal or vertical fashion, typically having wheels allowing the canister means to be pushed and/or pulled around.

Upright vacuum cleaners are employed when a canister vacuum is mounted on a rigid, upwardly directed post, pivotally associated with a carpet-sweeper type of suction cleaning tool, usually having a beater bar or brush, adapted for rolling motion upon a floor surface. In such an embodiment, a user grasps a handle and pushes and pulls the vacuum cleaner across the floor surface.

Backpack vacuum cleaners involve taking a canister vacuum and attaching the canister vacuum cleaner, through use of a backpack attachment, to a users back. In such an arrangement the vacuum is often worn as a scuba diver wears a scuba tank. An example of such a backpack vacuum can be seen in U.S. Pat. No. DES. 312,517 (Hohrein, II et al.).

The use of small, hand-held vacuum cleaners is also well known. For instance, U.S. Pat. No. 5,794,303 to Sarfilippo et al. The use of portable blowers is also known, for instance, U.S. Pat. No. 5,735,018 to Gallagher, et al.

Various combinations of these different modes have also been disclosed in the prior art. For instance, Lee (U.S. Pat. No. 5,842,254) discloses a dual-mode vacuum cleaner which can be used in both canister mode and upright mode. U.S. Pat. No. 5,836,047 (Lee, et al.) discloses another vacuum cleaner able to be used in both upright and canister modes. A combination canister and upright vacuum is shown in Werner, et al. (U.S. Pat. No. 5,054,157). A combination canister (tank) and handheld vacuum is shown in Meyer (U.S. Pat. No. 4,845,793). Another combination canister and upright vacuum cleaner is shown in U.S. Pat. No. 3,310,828 (Clark, et al.) Tapp (U.S. Pat. No. 4,393,536) discloses a dual-mode vacuum cleaner of canister and upright conjunction. Finally, Fleischhauer (U.S. Pat. No. 4,809,395) discloses a canister type vacuum cleaner able to be used in an upright and prone position.

What is needed, and not shown in the prior art, is a cleaning apparatus convertible between upright, canister, and backpack modes, and additionally, handheld and blower modes. The present invention solves these needs.

Additional advantages and novel features of the invention will be set forth in part in the description as follows, and in part will become apparent to those skilled in the art upon examination of the following, or may be learned by practice of the invention. The advantages of the invention may be realized and attained by means of the instrumentalities and combinations particularly pointed out in the appended claims.

SUMMARY OF THE INVENTION

The present invention is a cleaning apparatus which is convertible between upright, canister, backpack, handheld and blower modes. The cleaning apparatus has power unit assembly which has an electric motor powering an impeller. In this manner, the power unit establishes a suction which creates an airflow in an in-port and out an exhaust port. The electric motors is connected to a power source, whether that be a standard wall outlet, a rechargeable battery or other means. An on-off means is used to turn the power unit on or off. It is preferred that this assembly be encased within a housing. This housing is capable of attachment to various other components including a base unit through a base unit attachment means or a power head through a head attachment means.

Another component of the cleaning apparatus is a base unit. This base unit contains the filtering means for the vacuuming modes. This filter means is located between an intake port, which can be connected to a hose or other device and, an exhaust port. The exhaust port is able to fluidly connect with the intake port of the power unit assembly. This allows a suction to draw air in the intake port through the filter means and out the exhaust port when the base unit is connected to the power unit assembly. The base unit is also capable of attachment to a backplate with a backplate attachment means. The base unit may have various wheels, caster, or other devices allowing the base unit to either be set in a vertical, horizontal, or other mode.

A handle means may attach to the device, thereby allowing the device to be used in an upright form as standard household vacuum cleaners are used.

Attaching to the base unit or power unit can be a power head. This head is for contacting a surface, and can be used in all forms, particularly when the device is use in its upright form. It is preferred that this head be able to be easily releasably attachable to the power unit or base assembly, preferably through use of an alignment pin or other device.

The device may also comprise a backplate which is capable of being releasably attached to either the base unit or the power unit of the device. This backplate contains a backplate pad, shoulder straps or belts, if necessary, and the engagement means that allows the releasable attachment to a base unit. This backplate allows the apparatus to be worn on a users back in a backpack mode much as a scuba tank is worn by a scuba diver.

The device is further able to be used in a canister mode by placing the base unit as attached to the power unit assembly on a floor surface, either in a vertical, horizontal or other fashion.

The device is also capable of being used in a handheld mode by having the user hold the device in his/her hands through use of the handle means.

It is also envisioned that the device can be used in a blower means by attaching a blower attachment to the exhaust port of the power unit assembly. In such a configuration, it is preferred that the base unit be removed for easier maneuvering of the device, however, it is possible that the base unit can be left on the device. In the blower mode, it is also envisioned that either a carrying cover or other means will be attached to the power unit for assisting in the carrying of the device by an individual, or a shoulder strap could be attached thereby allowing the user to more easily carry the blower means. It is also possible that the apparatus could be worn as a backpack blower.

Also envisioned is the ability to convert to a power tool dust collection system. In such a configuration, the power unit assembly would be able to attach to a bench canister conversion cap. The bench canister conversion cap attaches through a connection or hose to a work bench waste container or canister. This canister further connects through a connection or hose to a particulate substance collector. This collector can be located adjacent to a power tool, such as next to a power saw blade, thereby allowing the embodiment to vacuum and collect saw dust.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
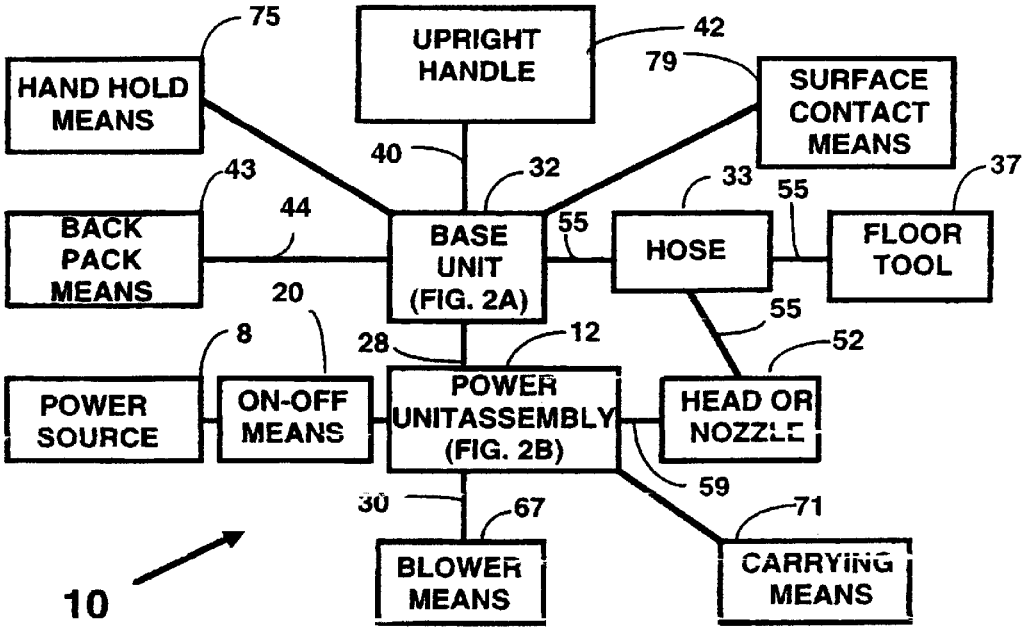
FIG. 1 is a flowchart depicting one embodiment of the present invention.

While the invention is susceptible to various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

One embodiment of the present invention is a cleaning apparatus convertible between upright, canister, and backpack modes. It is preferred that the cleaning apparatus also be convertible into a handheld mode and a blower mode. In the preferred embodiment, the apparatus comprises a plurality of different components which can be attached to convert the apparatus into and from various modes.

Figure 2A:
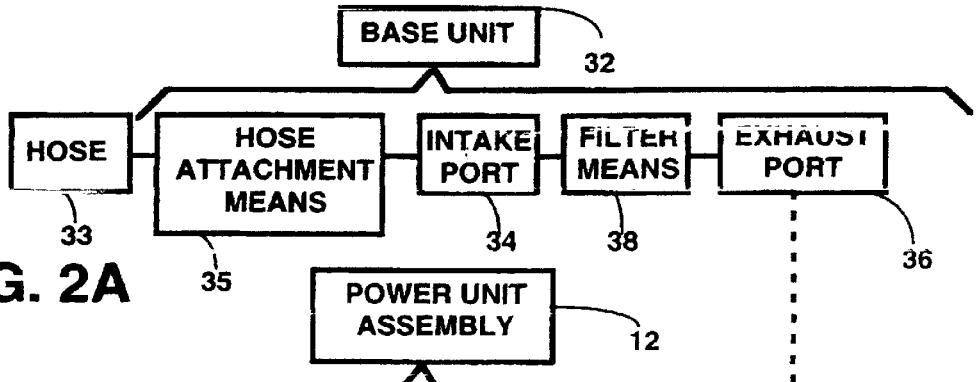
FIG. 2A is a flowchart depicting one embodiment of the base unit of the present invention.
Figure 2B:
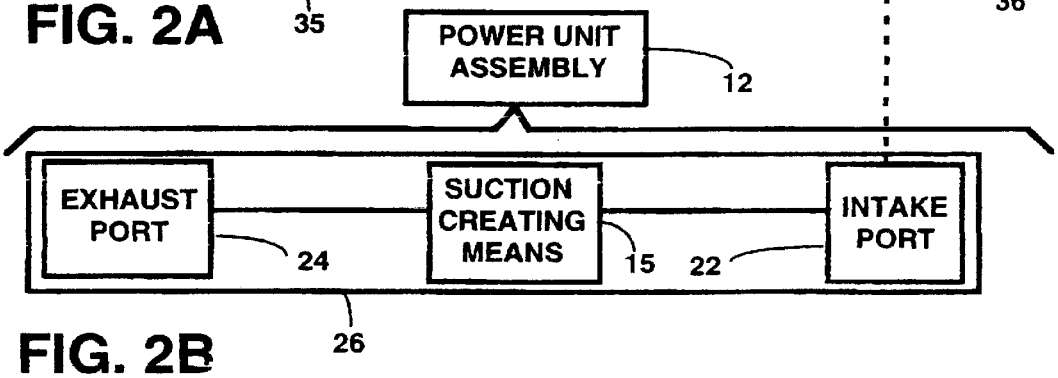
FIG. 2B is a flowchart depicting one embodiment of the power unit assembly of the present invention.
Figure 13:
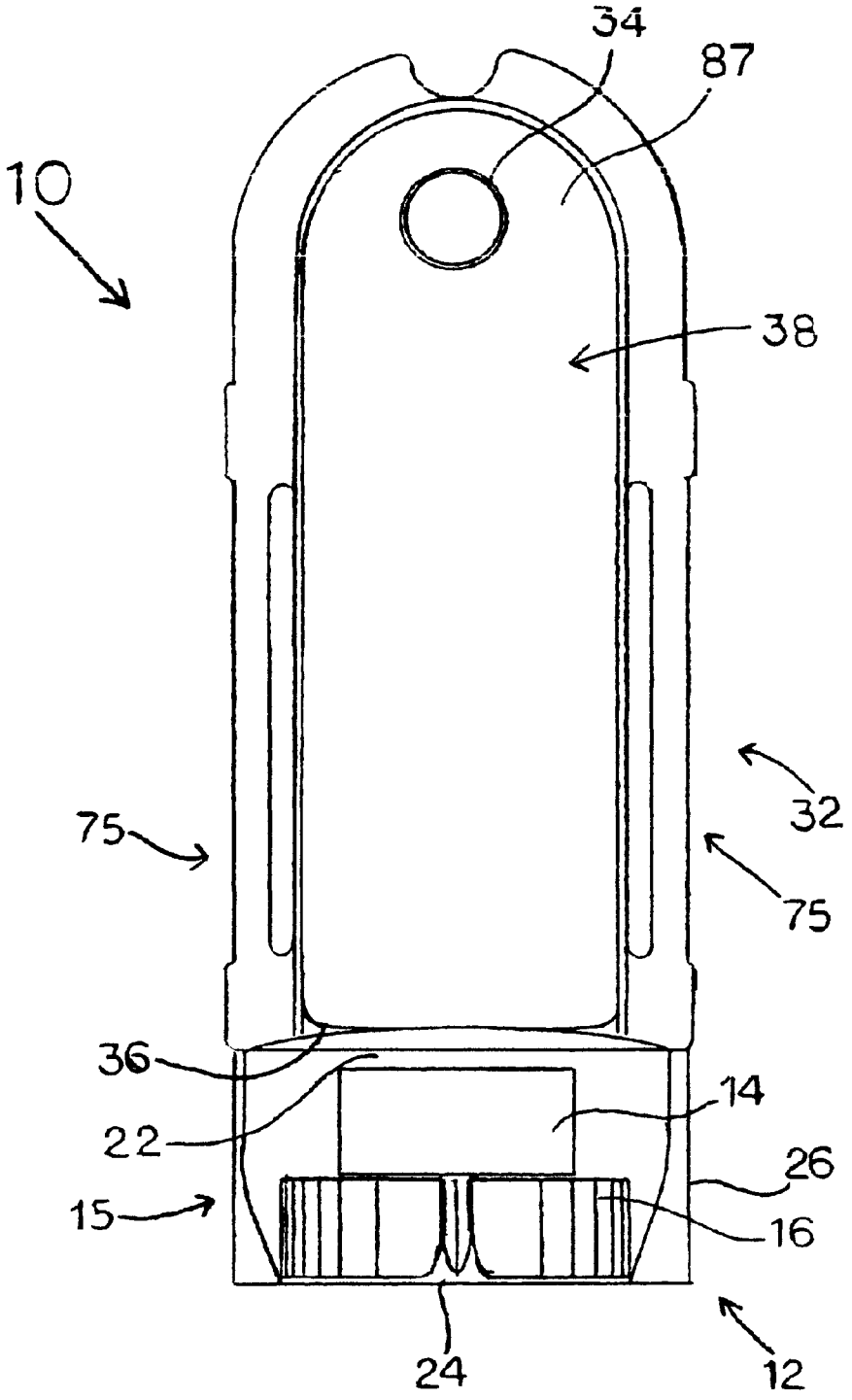
FIG. 13 is a partial, cross-sectional view of one embodiment of the present invention.

Referring to the flowchart shown in FIG. 1, of the preferred embodiment, the invented embodiment 10 has a power unit assembly 12. This power unit assembly 12 (shown in more detail in FIG. 2B) includes the suction creating means 15 of the device, and thus serves as the component responsible for the suction needed to operate in the vacuuming mode and the blowing mode. The power unit assembly 12 is enclosed within a housing 26, this housing 26 allowing for easier attachment and interchangeability of the power unit assembly 12 to other components. The suction creating means 15 (as shown in FIG. 13) further comprises a motor 14 powering an impeller 16 thereby creating a suction, an intake port 22 for receiving air drawn into the assembly 12 by the created suction, and an exhaust port 24 for exhausting such air.

Figure 9:
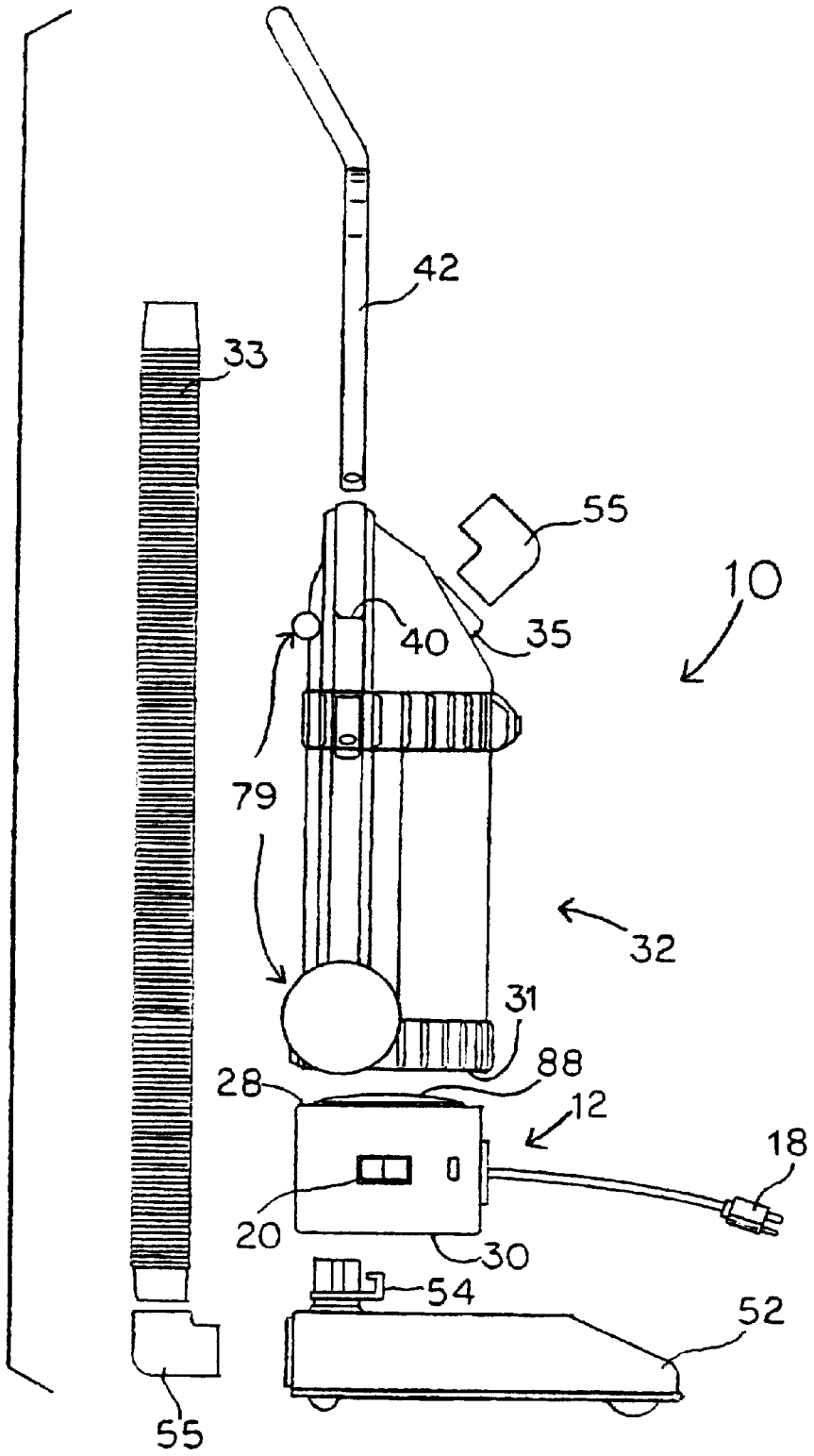
FIG. 9 is an exploded, side view of one embodiment of the present invention.

Referring again to FIG. 1, the power unit assembly 12 and the suction creating means 15 is powered through use of power source 8. This power source 8 can be any known power source, including, but not limited to, a rechargeable battery means, or standard 110 AC. Connection to the power source 8 may further be done through use of a power cord 18, as shown in FIG. 9. Referring back to FIG. 1, interconnected between the power source 8 and the power unit assembly 12 is an on-off means 20, such as a switch, allowing the power unit assembly 12 to be turned on and off. The assembly 12 further has a base unit attachment means 28 allowing the power unit assembly 12 to be attached to a base unit 32.

Figure 7:
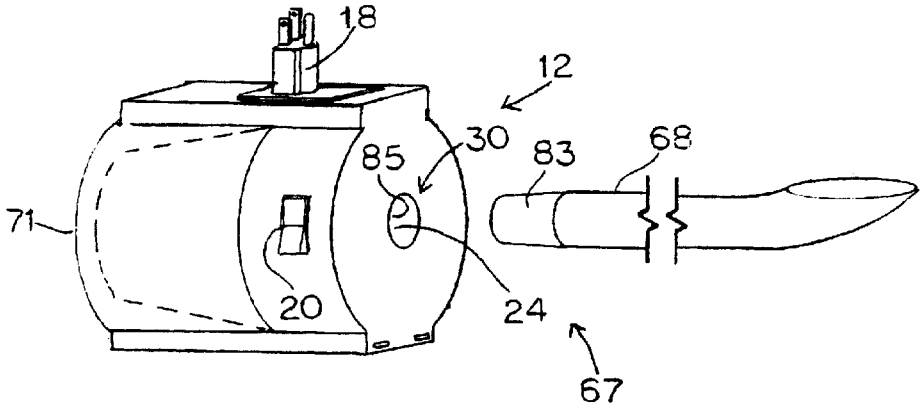
FIG. 7 is a perspective view of one embodiment of the blower mode of the present invention.

The exhaust port 24 of the power unit assembly 12 is further able to cooperate with a blower means 67, preferably through use of a blower attachment means 30. As shown in FIG. 7, the preferred blower attachment means 30 is an orifice 85 extending from the exhaust port 24 of the assembly. This orifice 85 is able to frictionally fit with the flange 83 of the blower nozzle 74, thereby converting the power unit assembly 12 into a portable blower. Other connection strategies could also be employed.

Figure 3:
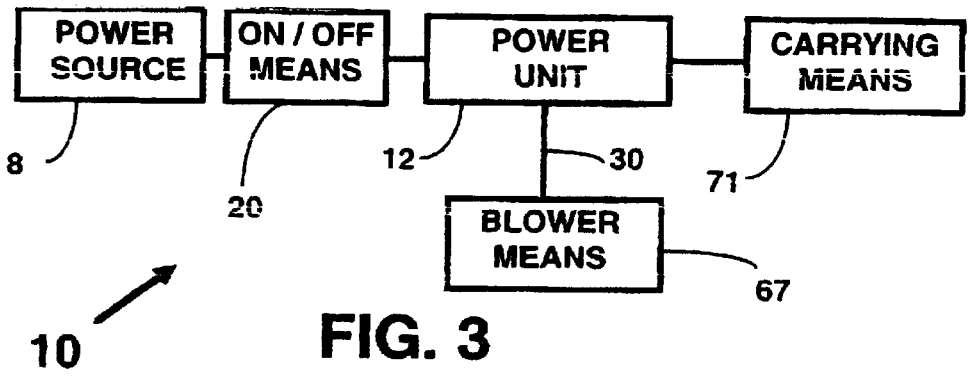
FIG. 3 is a flowchart depicting one embodiment of the blower mode of the present invention.
Figure 4:
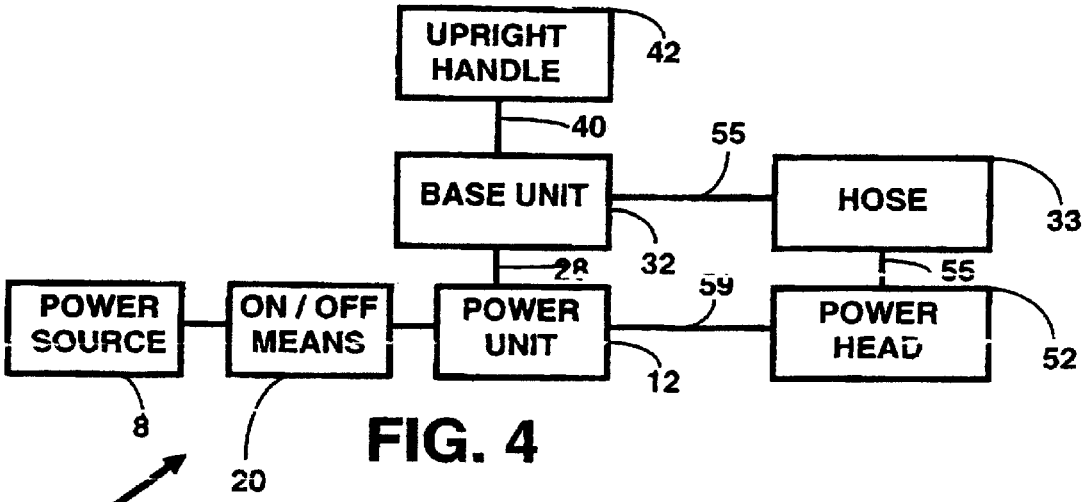
FIG. 4 is a flowchart depicting one embodiment of the upright mode of the present invention.

The apparatus 10 could then be used to do things such as blow leaves and dirt, or to blow an area free of dust. In use as a blower, the base unit 32 is not a necessary component and may be removed from the power unit assembly 12. If such detachment is done, the use of a carrying means 71 is necessary to assist in the carrying of the power unit assembly/blower means combination. Another embodiment of a blower mode of the apparatus 10 is shown in FIG. 3.

Figure 8A:
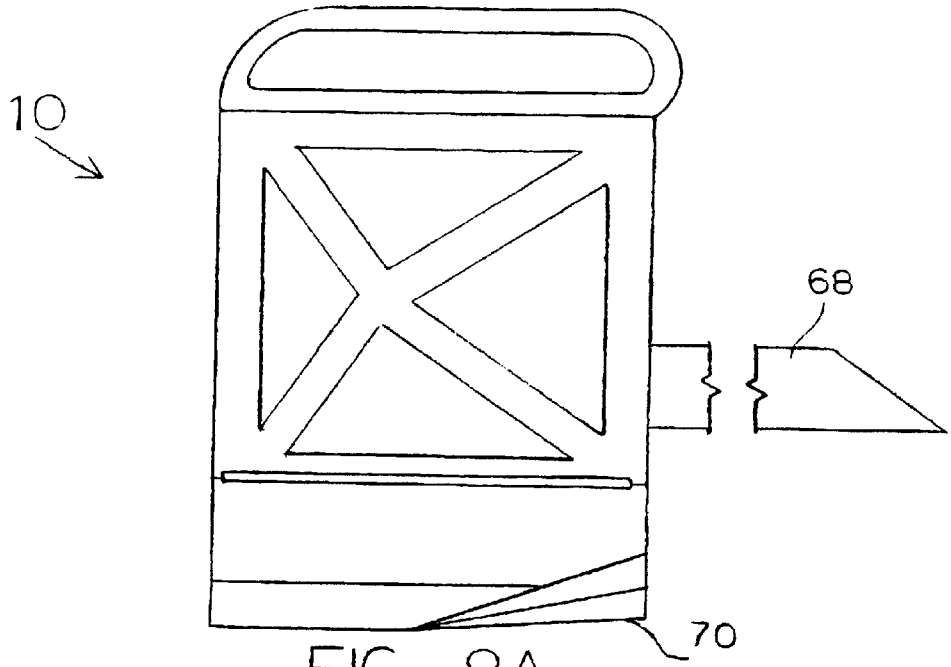
FIG. 8A is a side view of one embodiment of a carrying means used with the blower mode of the present invention.
Figure 8B:
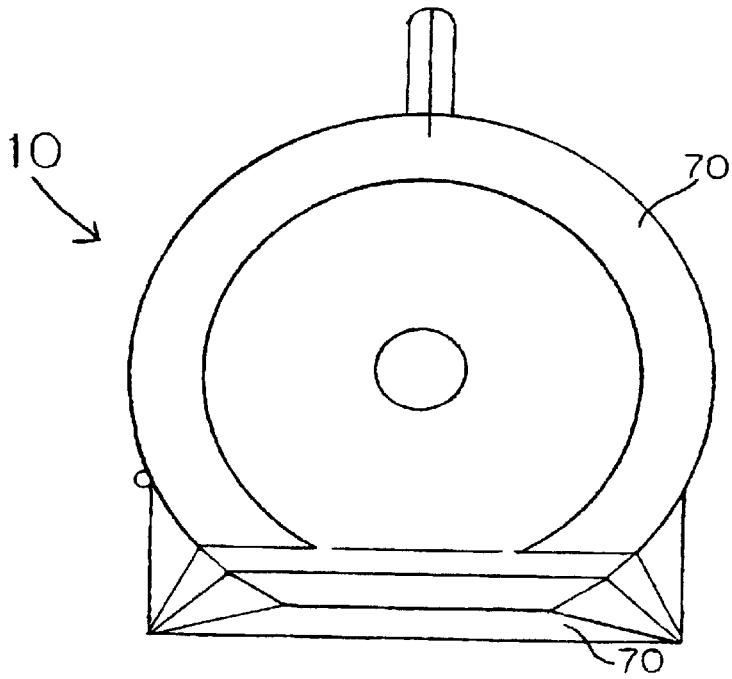
FIG. 8B is an end view of one embodiment of a carrying means used with the blower mode of the present invention.

Referring to FIGS. 8A and 8B, it is envisioned that such carrying means 71 may comprise a carrying cover, handle or straps 70. Additionally, the base unit 32 could be left upon the power unit 12 when used in a blower mode. In such an arrangement, the apparatus 10 could be set upon the floor surface 2, thereby creating a canister blower.

Figure 15:
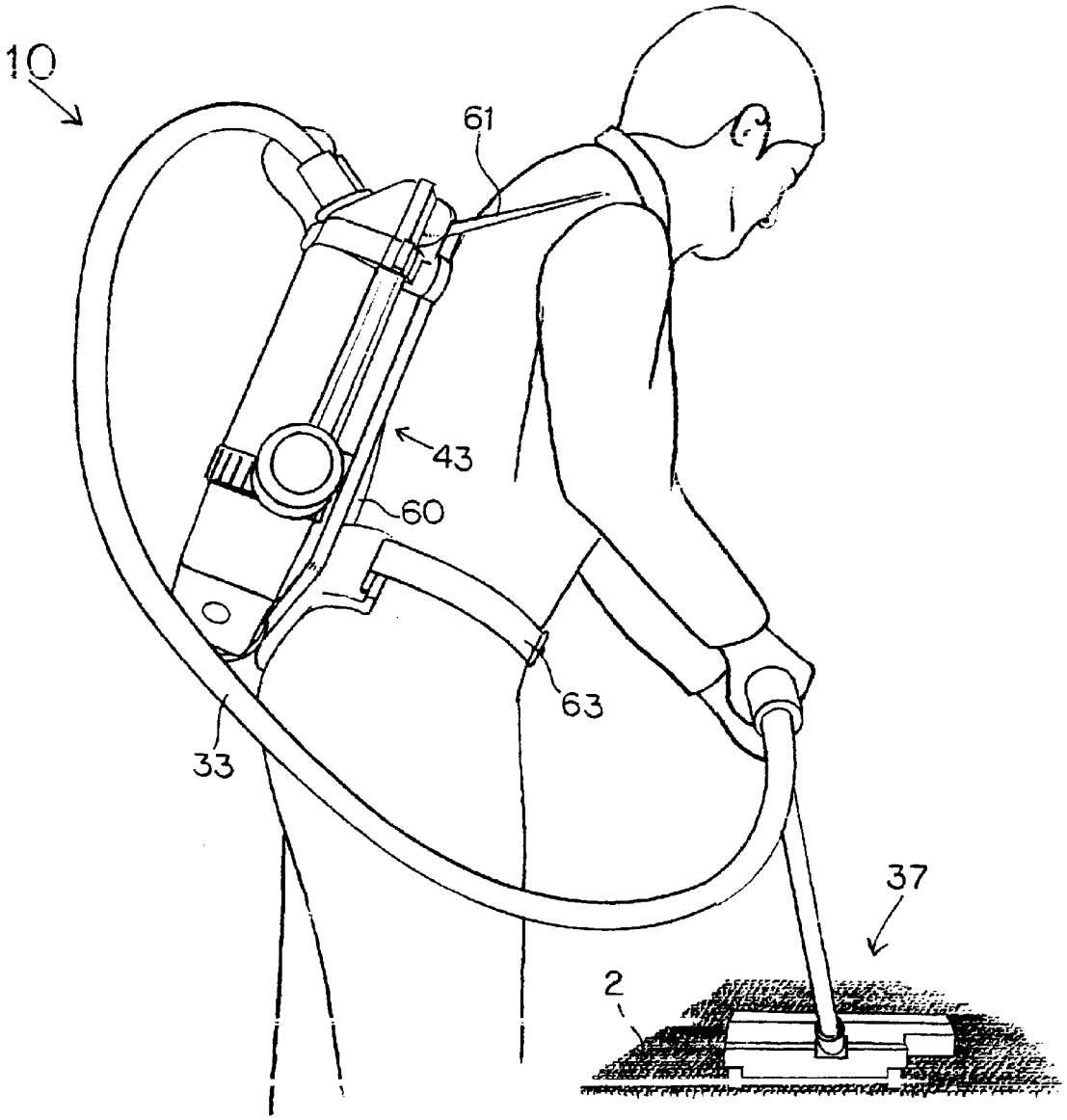
FIG. 15 is an environmental view of another embodiment of the present invention.
Figure 16:
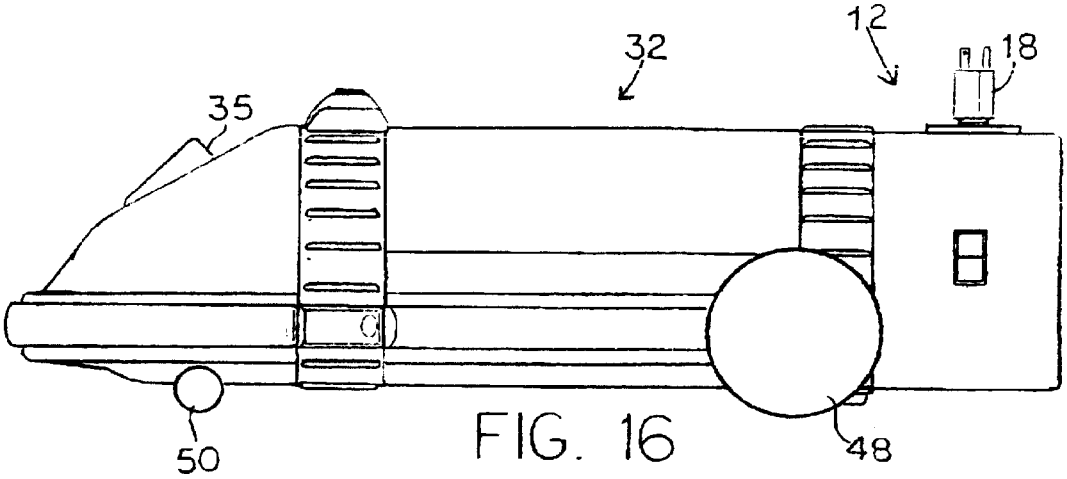
FIG. 16 is a side view of another embodiment of the present invention.
Figure 17:
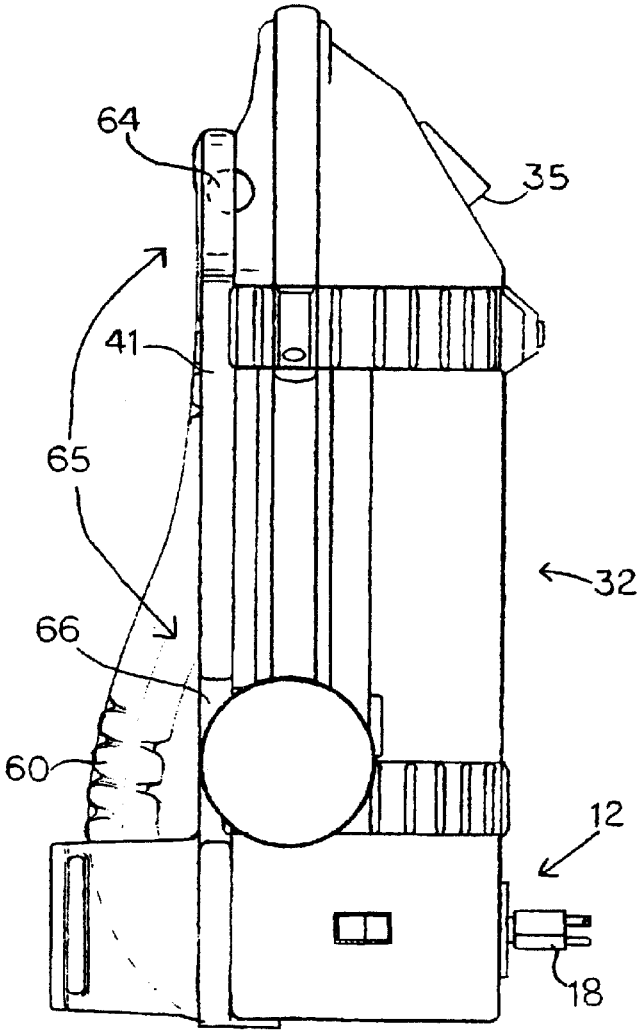
FIG. 17 is a side view of another embodiment of the present invention.
Figure 18:
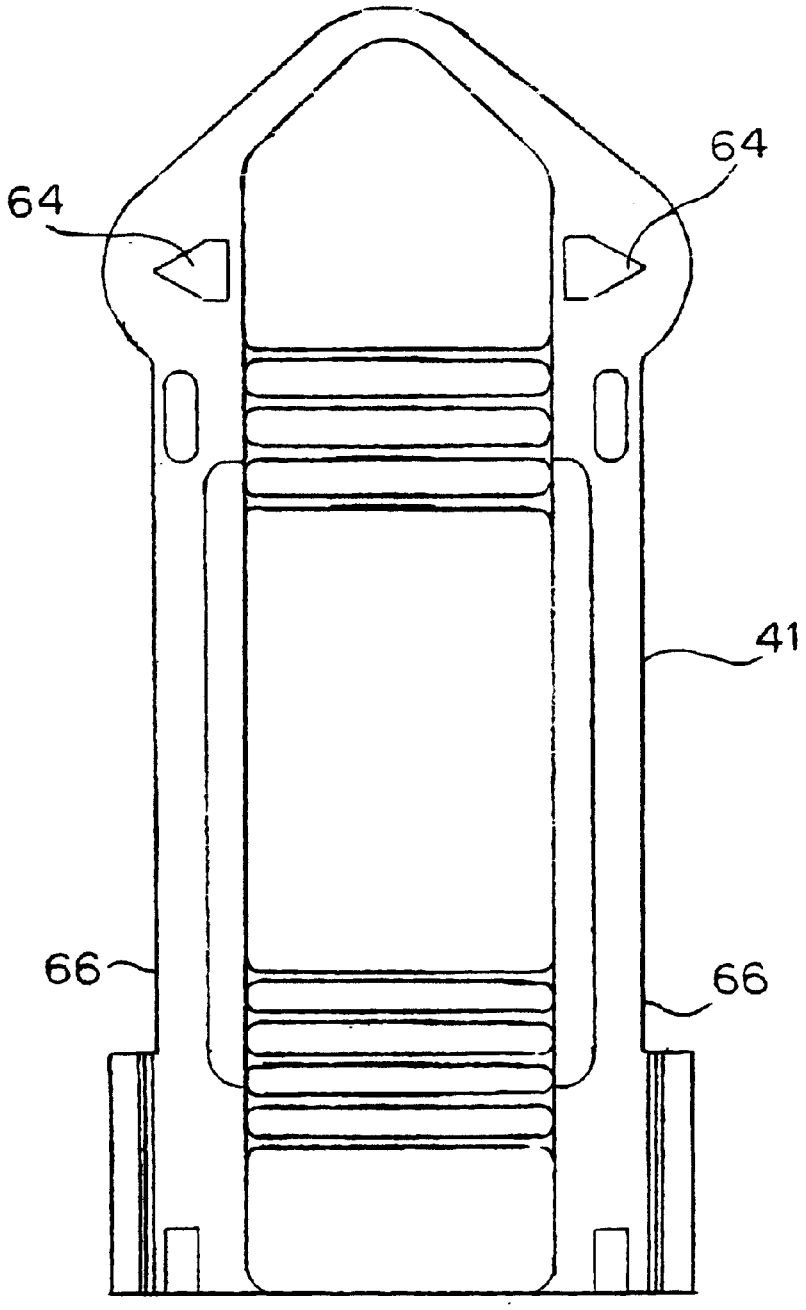
FIG. 18 is a partial, front side view of another embodiment of the present invention.
Figure 19:
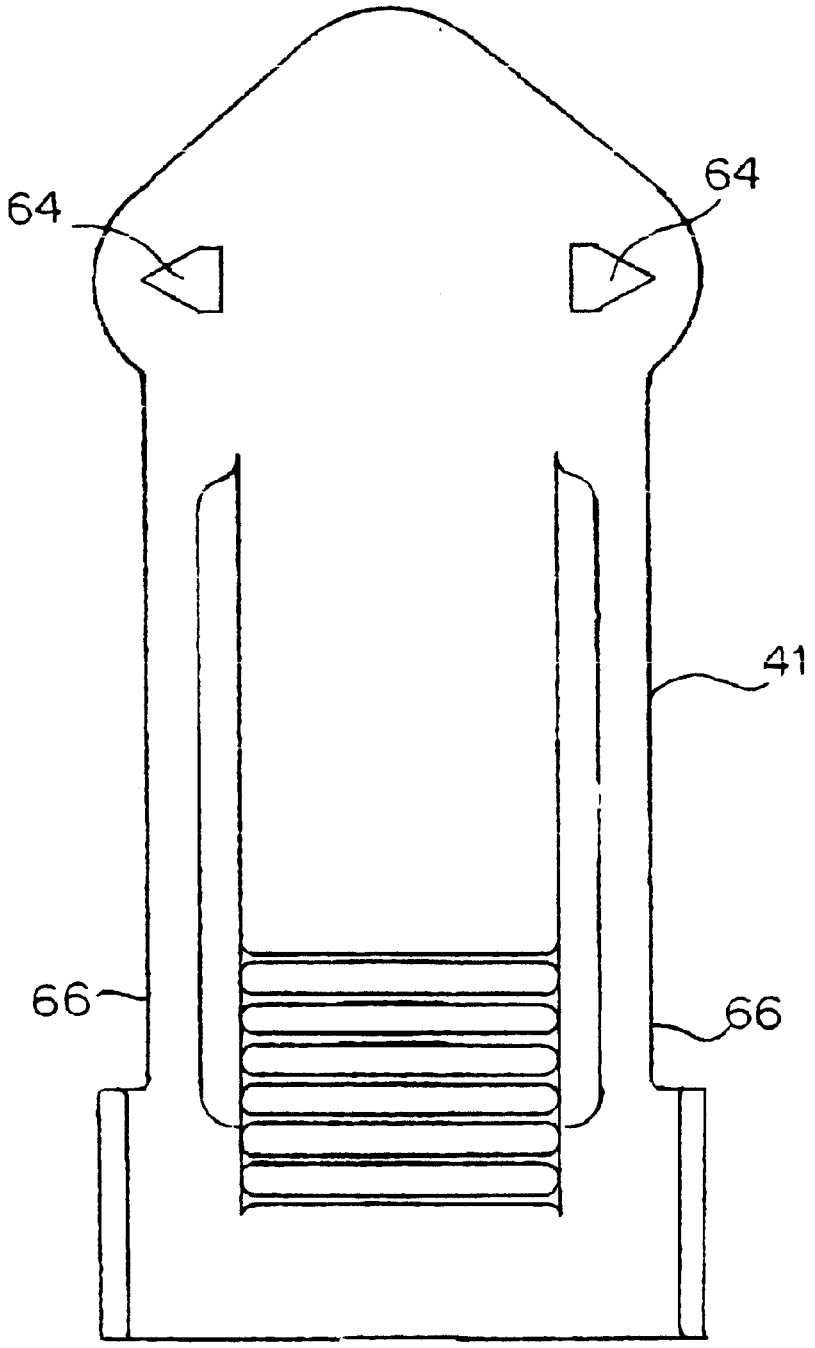
FIG. 19 is a partial, back side view of the embodiment of the present invention shown in FIG. 18.

As shown in FIG. 1, the preferred embodiment of the invented cleaning apparatus 10 further comprises a base unit 32. The base unit 32, as further shown in FIG. 2A, includes an intake port 34 that receives air containing a suspended particulate substance. This intake port 34 attaches to a hose attachment means or port 35 for cooperating with a vacuum hose 33. In such an arrangement, a user will be able to plug a hose 33 into the hose attachment means 35 and extend this hose 33 to a nozzle, brush or other means 37 (as shown in FIG. 15) for vacuuming substances such as dust, thereby creating a suspended particulate substance within an airflow. It is envisioned that hose connections 55 (as shown in FIG. 9) may be used to connect the hose 33 to the hose attachment means 35, or other components.

The base unit 32 further has an exhaust port 36. Located between the intake port 34 and the exhaust port 36 is a filter means 38. This filter means 38 is for separating, filtering, collecting and storing dust and other particulate matters suspended within air received into the intake port 34.

Figure 5:
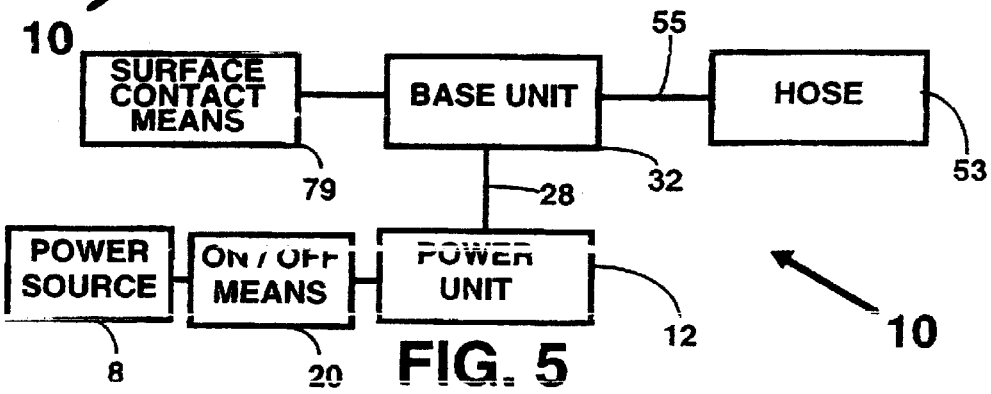
FIG. 5 is a flowchart depicting one embodiment of the canister mode of the present invention.

In use, the base unit 32 connects to the power unit 12 (as shown in FIG. 5) so that the suction created by the suction creating means 15 is interconnected with the base unit 32 so that air is drawn in through the intake port 34, through the filter 38 and out the exhaust port 36, as shown in FIG. 13. From the exhaust port 36 of the base unit 32, the airflow is sucked through the intake port 22 of the power unit 12 and out the exhaust port 24 of the power unit 12. Shown in FIG. 13 is a filter 38 in the form of a vacuum bag 87 which interconnects with the intake port 34.

Referring back to FIG. 1, the base unit 32 further comprises an upright handle mode attachment means 40 for allowing an upright handle means 42 to be attached to the base unit 32. This handle means 42 allows a user to grasp the handle and use the apparatus 10 in its upright form by pushing and pulling the apparatus 10 as any common upright vacuum cleaner. This allows the base unit 32 to be used in an upright vacuum mode. Embodiments of the upright vacuum mode are shown in FIGS. 4, 9, 10, 11 and 12.

Figure 10:
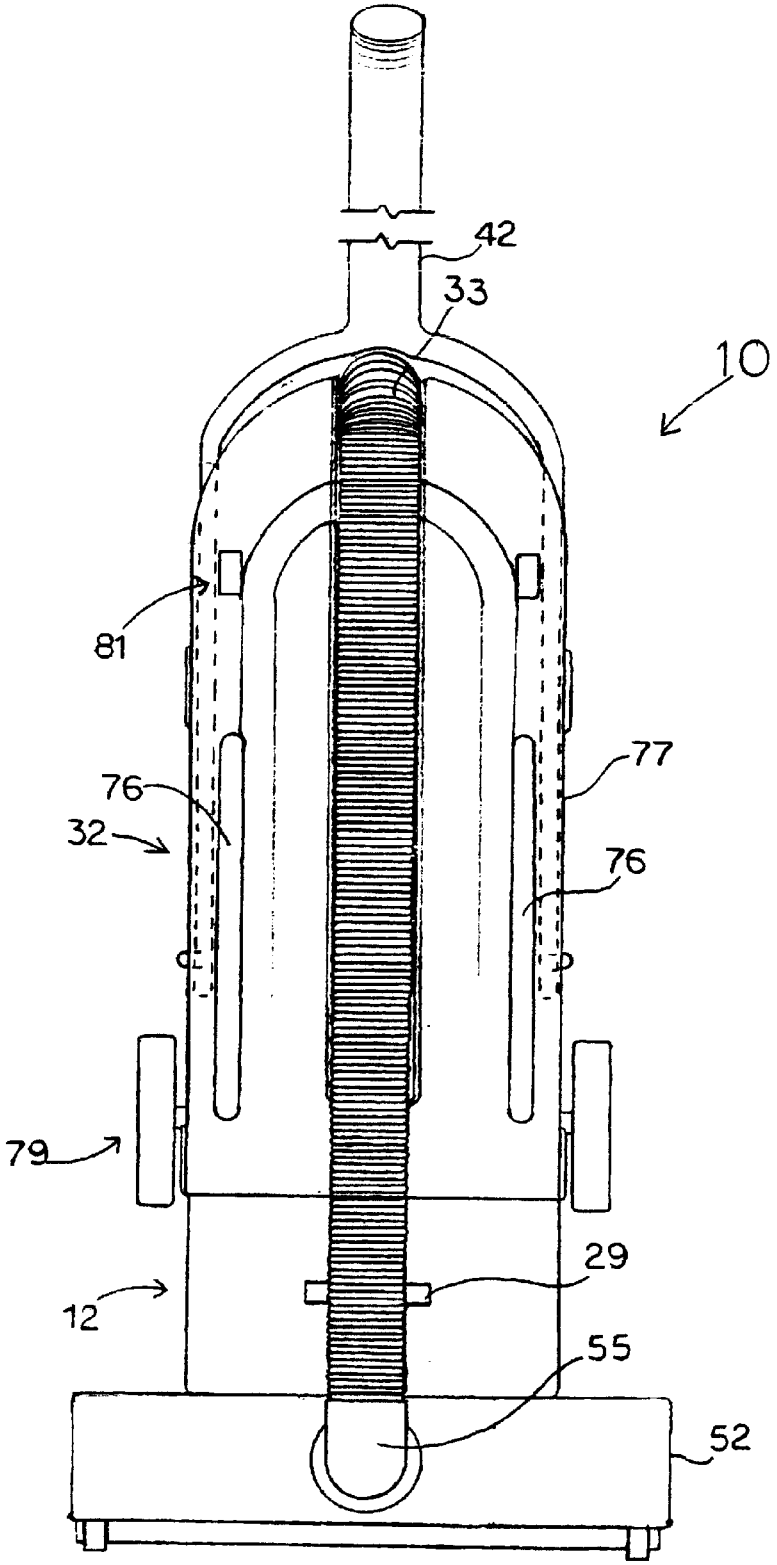
FIG. 10 is a back side view of one embodiment of the present invention.
Figure 11:
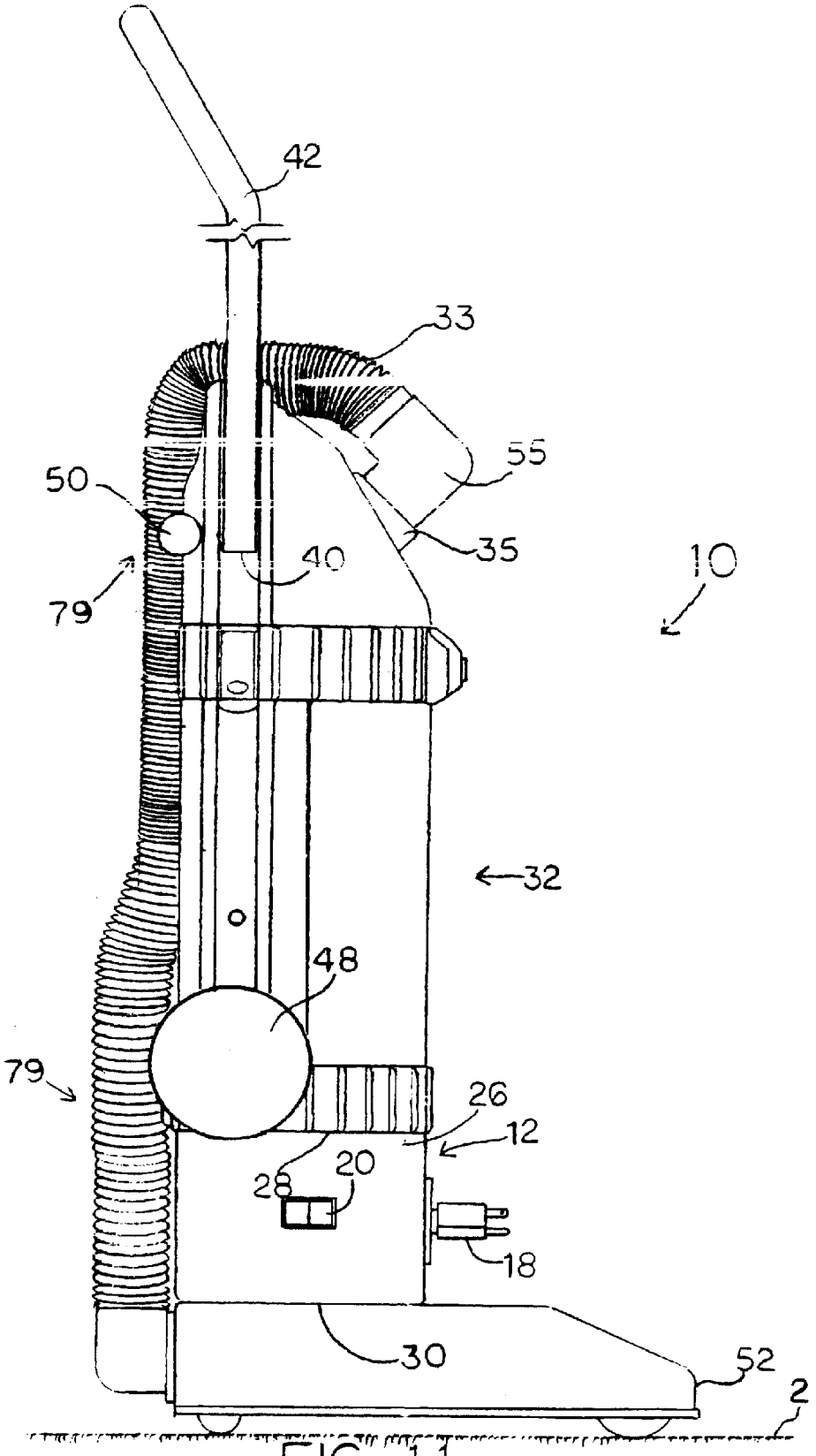
FIG. 11 is a side view of one embodiment of the present invention.
Figure 12:
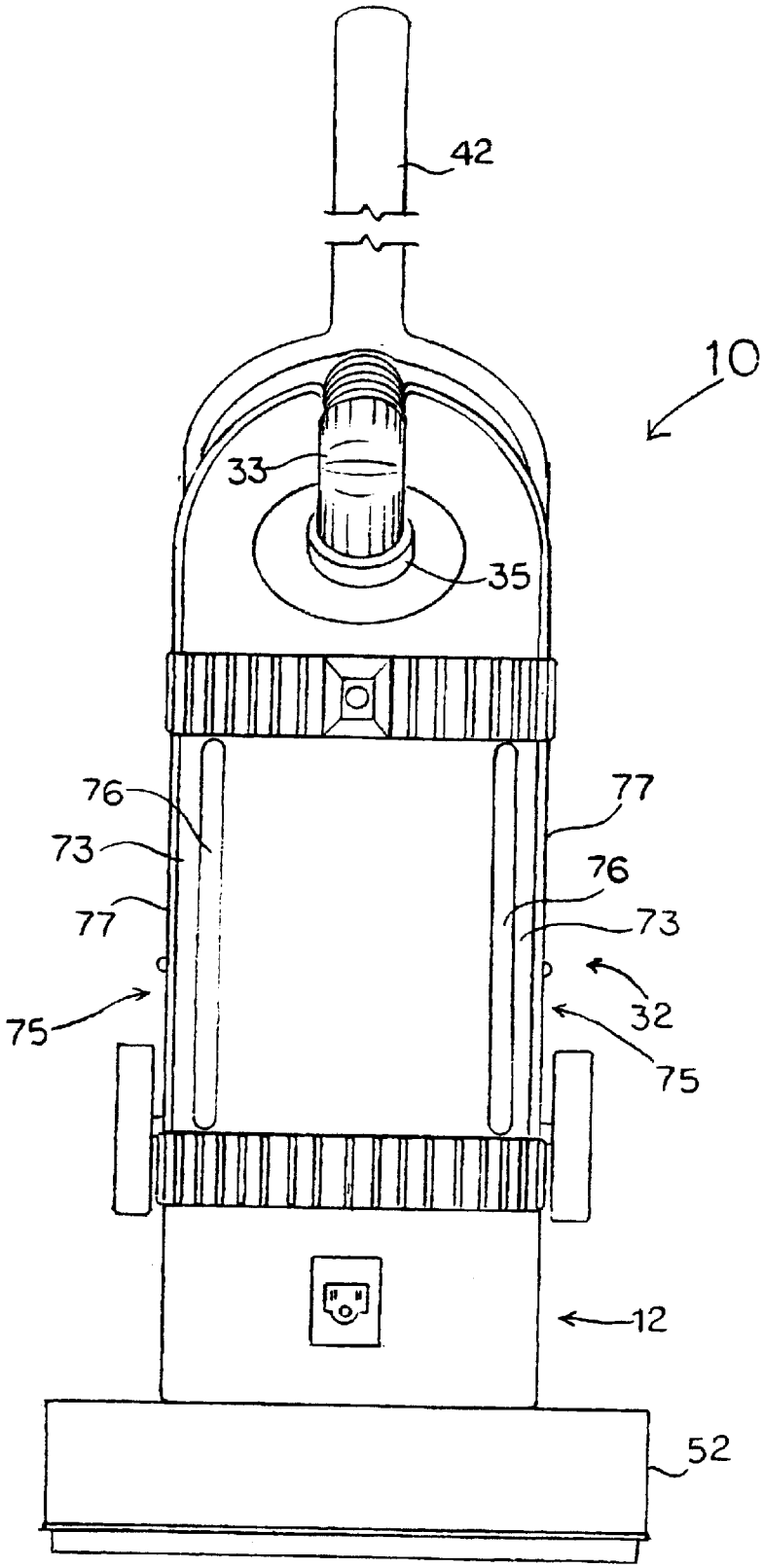
FIG. 12 is a front side view of one embodiment of the present invention.

The upright vacuum mode, as shown in FIGS. 9, 10, 11 and 12, preferably also uses an optional head or nozzle 52 which is attached to the power unit 12 of the apparatus 10 through use of a head attachment means 59. It is also envisioned that the head 52 could attach to the base unit 32 (which would be attached to the power unit 12) instead of the power unit 12 through the same or similar means. The head 52 is used for applying the vacuuming force to the floor surface 2, as shown in FIG. 11.

The head 52 can be either powered (rotating bristles) or unpowered (non-rotating bristles or non-bristled). The preferred head or nozzle 52 includes an alignment pin 54 for releasably connecting the nozzle 52 to the nozzle attachment means 30. The head attachment means 59 is preferably located upon the power unit assembly 12 itself, but may optionally be found upon the base unit 32. When used with the attached nozzle 52 and handle 42, the cleaning apparatus 10 is converted into an upright push mode, common to vacuum cleaners used in households.

The base unit 32 may further comprise at least one hand-held means 75 for allowing the apparatus 10 to be held easily within an operator's hands and used in a hand-held mode, as shown in FIG. 13. Optionally, the hand-held 75 means may be located on the power unit assembly 12. In the preferred embodiment, the hand-held means 75 comprises a slot 76 extending parallel to the side 77 of the base unit 32, thereby defining a hand hold or hand grip 73, These hand holds 76 are preferably hollow, and able to receive a Y-shaped upright handle 42, as shown in FIG. 10.

Figure 6:
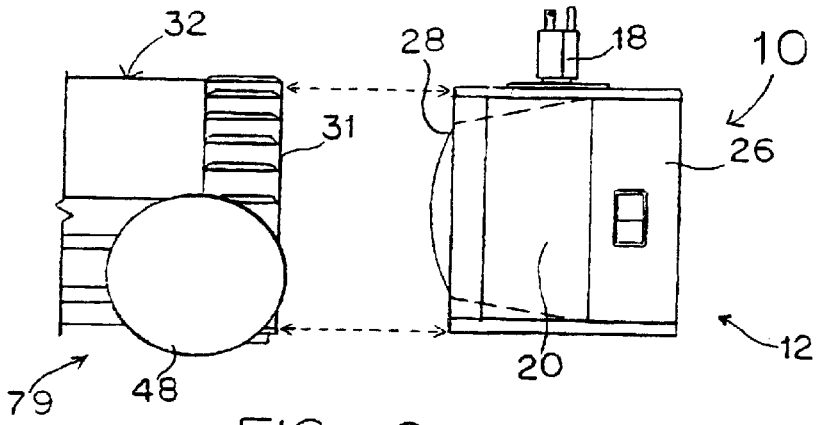
FIG. 6 is a partial, side view of one embodiment of the present invention.

The base unit 32 is also able to attach to a surface contact means 79. The surface contact means 79 can be any type of caster, glide, wheel, foot, or other device. The base unit 32 is able to be rested upon these surface contact means 79 in a variety of positions, including vertical and horizontal/prostrate. Examples of such surface contact means 79 can be found in FIGS. 6, 9, 10, 11, and 12, wherein is shown rear wheels 48 and casters 50. These wheels 48 and casters 50 further serve to allow the apparatus 10 to be pushed or pulled along a floor surface 2. If the base unit 32 with attached power unit 12 is placed upon a floor or other surface 2 (preferably on surface contact means 79), then the apparatus 10 is being used in a canister mode. One embodiment of the canister mode can be found in FIG. 6.

Figure 14:
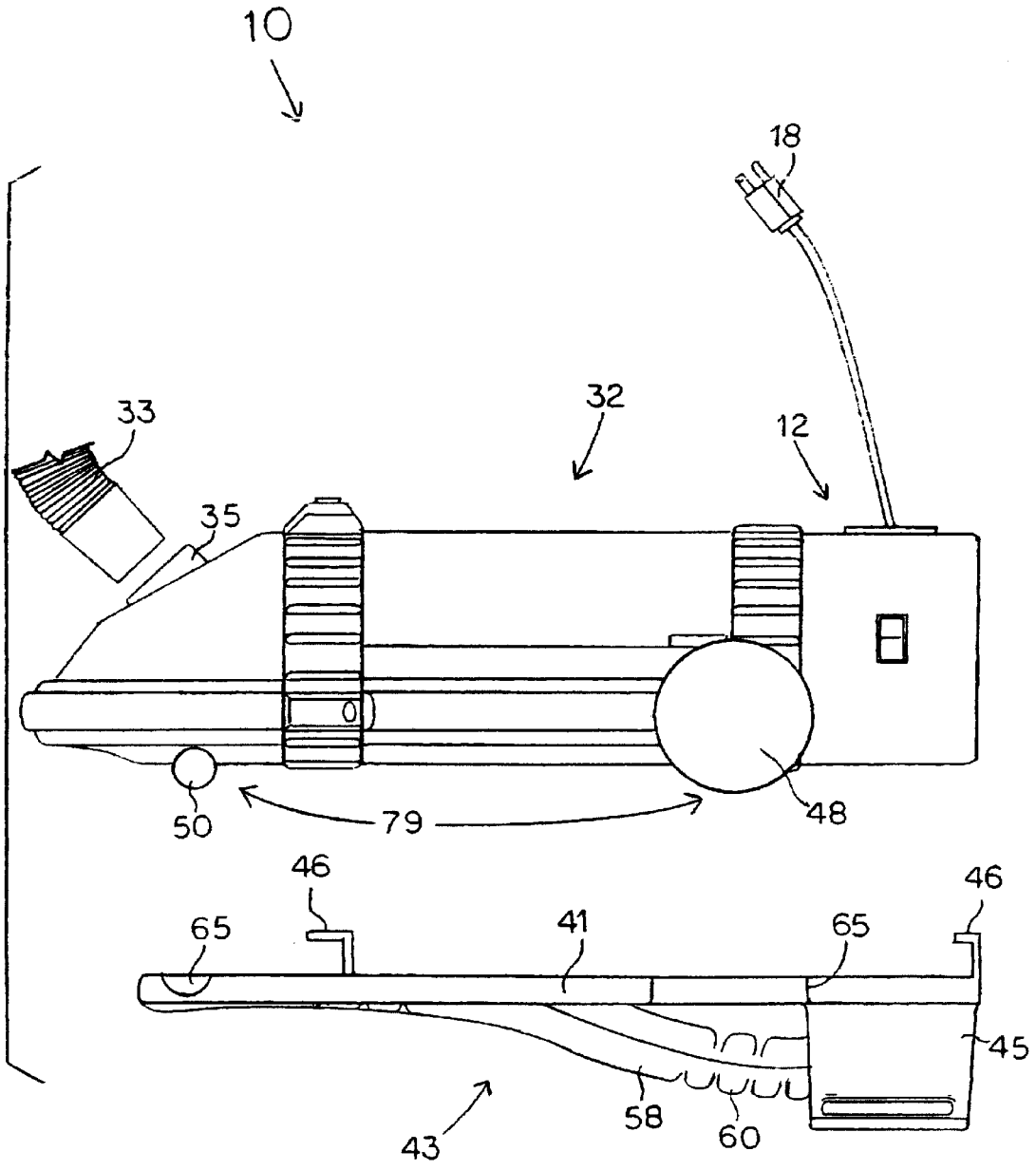
FIG. 14 is an exploded, side view of another embodiment of the present invention.

Another component of the preferred embodiment is the use of a backpack means 43, as shown in FIG. 14. In such means, a back plate 58 for contacting a wearer's back is able to releasably attach to the base unit 32 at a back plate mode attachment means 44. The back plate 58 includes a back plate pad 60 for comfortably interfitting with a wearer's back, an engagement means 46 allowing for releasable attachment to the base unit 32, and recesses 65 for receiving any casters 50 or wheels 48 that may be present on the under side of the base unit 32 itself. This backpack means 43 allows the apparatus 10 to be worn on the user's back in a backpack mode, either as a backpack vacuum (as shown in FIG. 15) or a backpack blower (not shown). Use in such backpack modes may be assisted through the use of shoulder straps 61 and/or a waist belt 63.

If the handle means 42 is attached as well as a power head 52, then the apparatus 10 is being used in its upright mode. If a blower nozzle 74 is attached to the power unit exhaust port 24, then the present invention 10 is being used in its blower mode.

Figure 20:
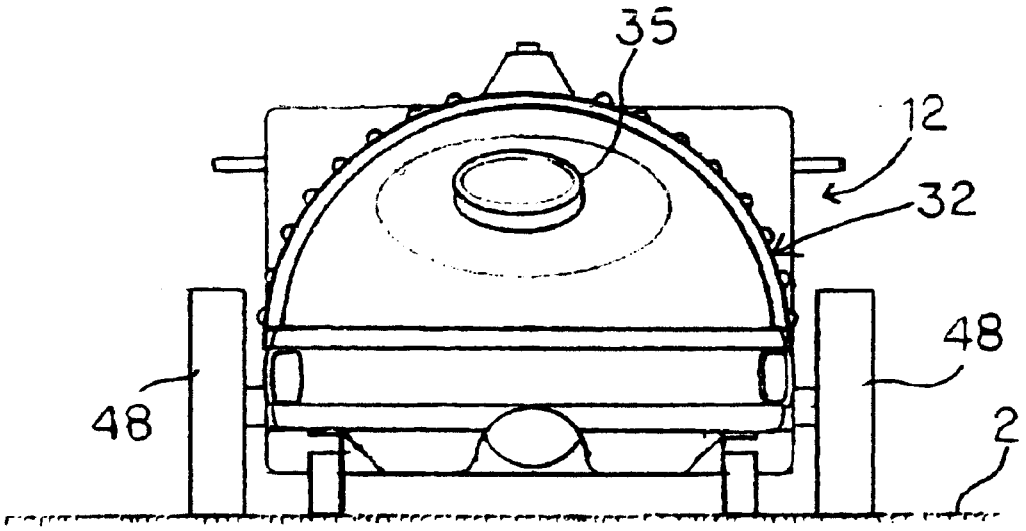
FIG. 20 is a top view of another embodiment of the present invention.
Figure 21:
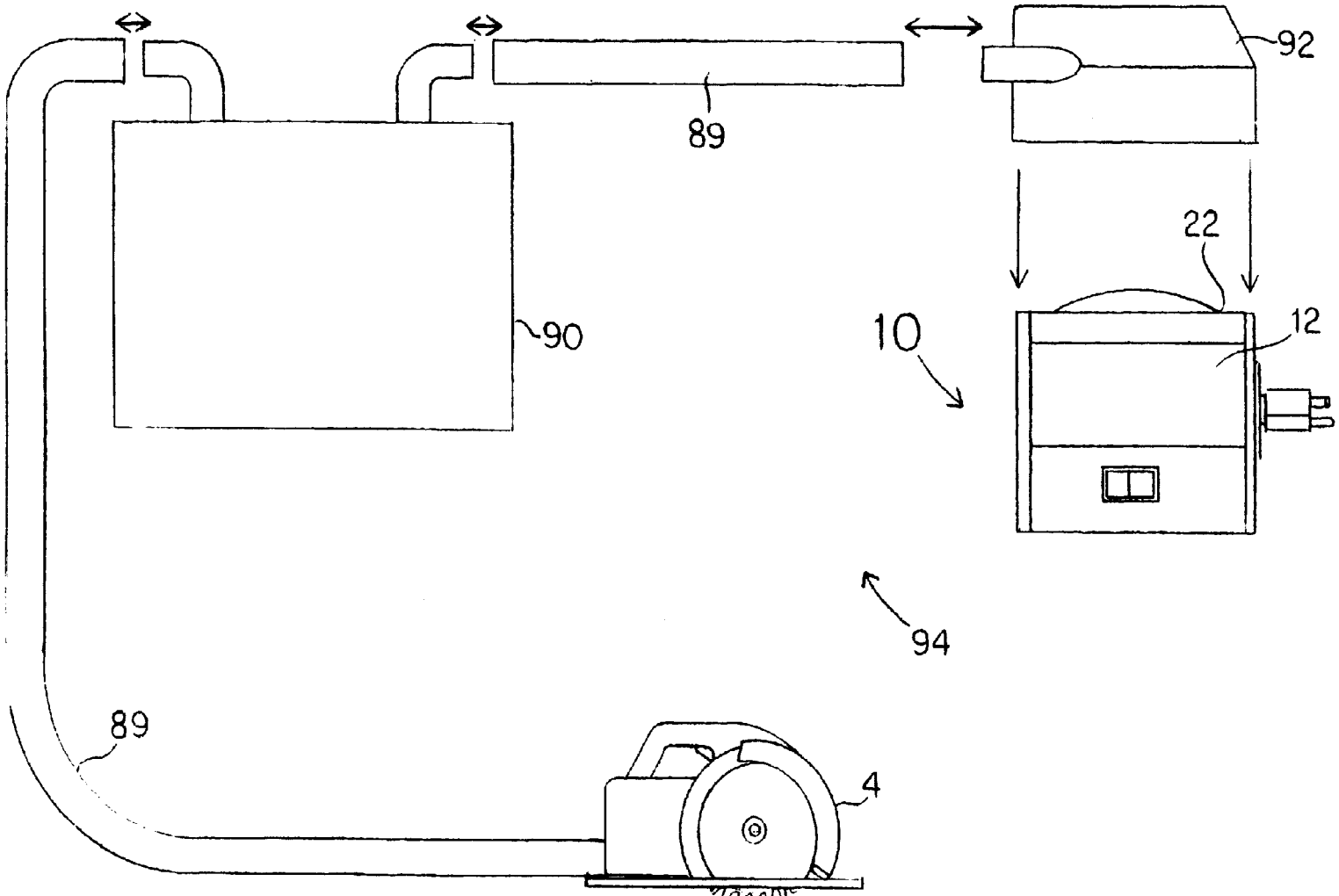
FIG. 21 is an environmental view of another embodiment of the present invention.

As shown in FIG. 20, also envisioned is the ability to convert to a power tool dust collection system 94. In such a configuration, the power unit assembly 12 would be able to attach to a bench canister conversion cap 92 at the power unit assembly 12 intake port 22. The bench canister conversion cap 92 attaches through a connection or hose 89 to a work bench waste container or canister 90. This canister 90 further connects through a connection or hose 89 to a particulate substance collector 94. This collector 94 is preferably located adjacent to a power tool 4. For instance, the collector 94 can be located next to a power saw blade, thereby allowing the embodiment to vacuum and collect saw dust.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A cleaning apparatus convertible between upright, canister, and backpack modes, comprising: a power unit assembly including: an electric motor, an impeller powered by said electric motor to establish a suction, thereby creating an airflow in an intake port and out an exhaust port, a power cord connecting said motor to a power source, an on/off means for turning said motor on and off, an intake port for receiving air from a base unit, an exhaust port for exhausting air, a power unit housing for containing said power unit assembly, a base unit attachment means for attachment with a base unit, and a head attachment means for attachment with a head; a base unit including: an intake port for receiving air containing a suspended particulate substance, said intake port further comprising a hose attachment means for cooperation with a hose; a filter means for separating, filtering, collecting, and storing said particulate substance, thereby creating filtered air, an exhaust port for venting said filtered air to said power unit intake port, an upright handle attachment means for attachment with a handle means, a backplate attachment means for attachment with a backplate, a pair of rear wheels and a front surface contact means; a handle means for attachment to said base unit, whereby a user is able to grasp said handle means and thereby use said apparatus in upright form; a head for contacting a floor surface, said head including an alignment pin for releasably connecting said head with said head attachment means of said power unit assembly; and a backplate for releasable attachment with said base unit, said backplate including: a backplate pad, engagement means for releasable attachment to the base unit, and shoulder straps and a belt for allowing said backplate to be worn on the user's back; wherein said backplate allows said apparatus to be worn on a user's back in a backpack mode; wherein said base unit can be placed upon said floor surface, said apparatus thereby in a canister mode; and wherein handle means allows a user to push and pull said apparatus across said floor surface, said apparatus thereby in a upright mode.

2. The cleaning apparatus convertible between upright, canister, and backpack modes of claim 1 further comprising a blower attachment for cooperation with the exhaust port of the power unit thereby creating a blower, said blower attachment including: means for attaching a carrying cover to the power unit; and a blower nozzle cooperating with said power unit exhaust port; whereby said apparatus can be worn as a backpack blower; and whereby said apparatus can be set upon said floor surface and used as a canister blower.

3. The cleaning apparatus convertible between upright, canister, and backpack modes of claim 1 further comprising a hand held means, said hand held means comprising at least one handle for allowing a user to use the apparatus in a hand held mode.

4. A vacuum cleaner convertible between upright, canister and backpack modes, comprising:

a power unit assembly having an electric motor, an impeller powered by said electric motor to establish a suction, thereby creating an airflow in an intake port and out an exhaust port, said intake port for connecting with a base unit exhaust port, a power cord connecting said motor to a power source, and an on/off means for turning said electric motor on and off; a base unit having a base unit intake at a hose attachment port, and having a base unit exhaust, said base unit containing a filter section for filtering airflow into said base unit intake and out said base unit exhaust, said base unit having a base able to be rested on a floor surface thereby allowing said vacuum cleaner to be used in a canister mode; an upright mode attachment comprising a handle for connecting with said base unit, a power head for contacting a floor surface, a power head hose for connecting said power head to said hose attachment port, said upright mode attachment thereby allowing said vacuum cleaner to be used in an upright mode; and a backplate mode attachment comprising a backplate having a backplate pad, shoulder straps and a waist strap, said backplate having an attachment means for releasable attachment with said base unit, said backplate mode attachment further comprising a vacuum hose connecting to said hose attachment port, said backpack mode attachment enabling said vacuum cleaner to be worn as a backpack on a user's back, and used in a backpack mode.

5. The vacuum of claim 4 which further converts to a handheld mode by said base unit further comprising at least one hand grip.

6. The vacuum of claim 4 which further converts to a blower mode by detachment of said motor unit from said base unit, and use of a blower mode attachment comprising means for attaching a carrying cover to said motor unit, means for carrying said carrying cover, and a blower nozzle cooperating with said motor unit exhaust port.

7. A convertible cleaning apparatus comprising: an elongated vacuuming means for receiving air containing suspended particulate substance and removing said suspended particulate substance from said air, said vacuuming means having an intake and an exhaust, said vacuuming means having a backpack means, a prostrate canister means, an upright canister means, a handheld means, an upright push/pull means and a blower means, wherein said backpack means is for allowing said apparatus to be worn on a user's back, said backpack means attaching to said vacuuming means through use of a backpack attachment means; wherein said prostrate canister means comprises a floor contact means for support of said elongated vacuuming means in a generally horizontal fashion; wherein said upright canister means comprises a second floor contact means for support of said elongated vacuuming means in a generally vertical fashion; wherein said handheld means comprises at least one handle on said elongated vacuum means allowing said apparatus to be carried in an operator's hands; wherein said upright push/pull means comprises a handle for allowing the user to push and pull said elongated vacuuming means across a surface, and a power head for contacting said surface, said power head operatively connected to said vacuuming means; and wherein said blower means comprises a means for attaching a carrying means to said vacuuming means, and a blower nozzle means for directing said exhaust from said vacuum means.

8. The convertible cleaning apparatus of claim 7, wherein said floor contact means are casters.

9. The convertible cleaning apparatus of claim 8, wherein said second floor contact means are casters.

10. The convertible cleaning apparatus of claim 7, wherein said backpack attachment means comprises a backplate for releasable attachment with said elongated vacuuming means through use of said backplate attachment means, said backplate including: a backplate pad, a floor contact means recess for receiving said floor contact means of said prostrate canister means, said backpack means for allowing a wearer to wear the backplate and attached device on the wearer's back.

11. The convertible cleaning apparatus of claim 7, wherein said elongate vacuuming means comprises a power unit having an electric motor, an impeller powered by said electric motor to establish a suction, thereby creating an airflow in an intake port and out an exhaust port, said intake port for connecting with a base unit exhaust, a power cord connecting said motor to a power source, and an on/off means for turning said motor on and off; and a base unit having an base unit intake at a hose attachment port, and having a base unit exhaust, said base unit containing a filter section for filtering airflow into said base unit intake and out said base unit exhaust.

12. The convertible cleaning apparatus of claim 11, wherein said power source is rechargeable.

13. The convertible cleaning apparatus of claim 7, wherein said handheld means handle is hollow and receives therein said upright push/pull means handle.

14. The convertible cleaning apparatus of claim 13, wherein said apparatus has dual hollow handles, and said upright push/pull means handle is a generally inverted Y shape.

15. The convertible cleaning apparatus of claim 7, wherein said blower means further comprises a dome filter attaching to said vacuuming means at said vacuuming means intake.

16. The convertible cleaning apparatus of claim 7, wherein said apparatus further comprises a bench canister conversion cap for attaching to the power unit assembly intake port; a hose attaching to the conversion cap; said hose further attaching to a work bench waste canister; said canister further connecting through a second hose to a particulate substance collector.

17. A vacuum cleaner convertible between upright, canister, handheld, and backpack modes, comprising: a power unit assembly having a motor, an impeller powered by said motor to establish a suction, thereby creating an airflow in an intake port and out an exhaust port, said intake port for connecting with a base unit exhaust port, a power connection connecting said motor to a power source, and an on/off means for turning said motor on and off; a base unit having a base unit intake at a hose attachment port, and having a base unit exhaust, said base unit containing a filter means section for filtering airflow into said base unit intake and out said base unit exhaust, said base unit having a base able to be rested on a floor surface thereby allowing said vacuum cleaner to be used in a canister mode, said base unit having a handle allowing said vacuum cleaner to be used in a handheld mode; an upright mode attachment comprising a handle for connecting with said base unit, a power head for contacting a floor surface, a power head hose for connecting said power head to said hose attachment port, said upright mode attachment thereby allowing said vacuum cleaner to be used in an upright mode; and a backplate mode attachment comprising a backplate having a backplate pad, shoulder straps and a waist strap, said backplate having an attachment means for releasable attachment with said base unit, said backplate mode attachment further comprising a vacuum hose connecting to said hose attachment port, said backpack mode attachment enabling said vacuum cleaner to be worn as a backpack on a user's back, and used in a backpack mode.

18. A cleaning apparatus convertible between upright, canister, and backpack modes, comprising: a power unit assembly including: a suction creating means creating an airflow in an intake port and out an exhaust port, an on/off means for turning said suction creating means on and off, an intake port for receiving air from a base unit, an exhaust port for exhausting air, a power unit housing for containing said power unit assembly, and a base unit attachment means for attachment with a base unit; a base unit including: an intake port for receiving air containing a suspended particulate substance, said intake port further comprising a vacuum hose attachment means for cooperation with a vacuum hose; a filter means for separating, filtering, collecting, and storing said particulate substance, thereby creating filtered air, an exhaust port for venting said filtered air to said power unit intake port, a handle attachment means for attachment with a handle means, a backplate attachment means for attachment with a backplate, surface contact means; a handle means for attachment to said base unit, whereby a user is able to grasp said handle means and thereby use said apparatus in upright form; a head for contacting a floor surface, said head including an alignment pin for releasably connecting said head with said head attachment means of said power unit assembly; and a backplate, said backplate including: a backplate pad, shoulder straps and a belt for allowing said backplate to be worn on the user's back; wherein said backplate allows said apparatus to be worn on a user's back in a backpack mode; wherein said base unit can be placed upon said floor surface, said apparatus thereby in a canister mode; and wherein handle means allows a user to push and pull said apparatus across said floor surface, said apparatus thereby in a upright mode.

19. A vacuum cleaner convertible between upright and canister modes, comprising: a power unit assembly having a motor, an impeller powered by said motor to establish a suction, thereby creating an airflow in an intake port and out an exhaust port, said intake port for connecting with a base unit exhaust port, a power connection connecting said motor to a power source, and an on/off means for turning said motor on and off; a base unit having a base unit intake at a hose attachment port, and having a base unit exhaust, said base unit containing a filter means section for filtering airflow into said base unit intake and out said base unit exhaust, said base unit having a base able to be rested on a floor surface thereby allowing said vacuum cleaner to be used in a canister mode; an upright mode attachment comprising a handle for connecting with said base unit, a power head for contacting a floor surface, a power head hose for connecting said power head to said hose attachment port, and said upright mode attachment thereby allowing said vacuum cleaner to be used in an upright mode.

20. A vacuum cleaner convertible between upright and backpack modes, comprising: a power unit assembly having a motor, an impeller powered by said motor to establish a suction, thereby creating an airflow in an intake port and out an exhaust port, said intake port for connecting with a base unit exhaust port, a power connection connecting said motor to a power source, and an on/off means for turning said motor on and off; a base unit having a base unit intake at a hose attachment port, and having a base unit exhaust, said base unit containing a filter means section for filtering airflow into said base unit intake and out said base unit exhaust; an upright mode attachment comprising a handle for connecting with said base unit, a power head for contacting a floor surface, a power head hose for connecting said power head to said hose attachment port, said upright mode attachment thereby allowing said vacuum cleaner to be used in an upright mode; and a backplate mode attachment comprising a backplate having a backplate pad, shoulder straps and a waist strap, said backplate having an attachment means for releasable attachment with said base unit, said backplate mode attachment further comprising a vacuum hose connecting to said hose attachment port, said backpack mode attachment enabling said vacuum cleaner to be worn as a backpack on a user's back, and used in a backpack mode.

21. A vacuum cleaner convertible between canister, handheld, and backpack modes, comprising: a power unit assembly having a motor, an impeller powered by said motor to establish a suction, thereby creating an airflow in an intake port and out an exhaust port, said intake port for connecting with a base unit exhaust port, a power connection connecting said motor to a power source, and an on/off means for turning said motor on and off; a base unit having a base unit intake at a hose attachment port, and having a base unit exhaust, said base unit containing a filter means section for filtering airflow into said base unit intake and out said base unit exhaust, said base unit having a base able to be rested on a floor surface thereby allowing said vacuum cleaner to be used in a canister mode, said base unit having a handle allowing said vacuum cleaner to be used in a handheld mode; and a backplate mode attachment comprising a backplate having a backplate pad, shoulder straps and a waist strap, said backplate having an attachment means for releasable attachment with said base unit, said backplate mode attachment further comprising a vacuum hose connecting to said hose attachment port, said backpack mode attachment enabling said vacuum cleaner to be worn as a backpack on a user's back, and used in a backpack mode.

* * * * *